US005178908A

United States Patent [19]

Koyama

[11] Patent Number: 5,178,908

[45] Date of Patent: Jan. 12, 1993

[54] PROCESS FOR COATING CARBONIZED MATERIAL WITH METAL

[75] Inventor: Takao Koyama, Fujioka, Japan

[73] Assignee: Mitsubishi Pencil Co., Ltd., Tokyo, Japan

[21] Appl. No.: 609,101

[22] Filed: Nov. 5, 1990

Related U.S. Application Data

[63] Continuation of Ser. No. 361,769, May 30, 1989, abandoned, which is a continuation of Ser. No. 141,783, Jan. 11, 1988, abandoned.

[51] Int. Cl.[5] ..... B05D 1/12

[52] U.S. Cl. ..... 427/180; 427/227; 427/249; 427/255.4

[58] Field of Search ..... 427/180, 255.4, 249, 427/227

[56] References Cited

U.S. PATENT DOCUMENTS 3,752,655 8/1973 Ramqvist ..... 427/227

*Primary Examiner*—Shrive Beck
*Assistant Examiner*—Katherine A. Bareford
*Attorney, Agent, or Firm*—Oliff & Berridge

[57] ABSTRACT

A process for coating a carbonized material with metal is disclosed, wherein a chlorine-containing resin mixture is coated with Cr or Fe-Cr alloy to a thickness of substantially several microns. The coated product is then heated in an inactive atmosphere to carbonize the resin mixture. The process sufficiently coats a metal onto a carbonized material using relatively simple steps.

1 Claim, 2 Drawing Sheets

PROCESS FOR COATING CARBONIZED MATERIAL WITH METAL

This is a continuation of application Ser. No. 361,769, filed May 30, 1989, which in turn is a continuation of Ser. No. 141,783, filed Jan. 11, 1988, both now abandoned.

BACKGROUND OF THE INVENTION

The present invention relates to a process for coating a carbonized material with metal.

Heretofore, a carbonized material has been coated with metal by either ion sputtering, plasma discharge, electrolytic plating, or chemical plating. However, these methods have the following drawbacks: (1) it is difficult to coat metal onto a large material or a material having a complex shape; (2) it is difficult to coat metal onto a material having a complex shape so that all of the details of the shape are completely coated; and (3) apparatuses for complex coating operations are expensive.

SUMMARY OF THE INVENTION

Accordingly, an object of the present invention is to provide a process for coating a carbonized material with metal to eliminate the above-mentioned drawbacks and to sufficiently coat the material with metal in relatively simple steps.

To achieve the foregoing object of the present invention, a carbonized material is coated with Cr or Fe-Cr by the steps of contacting a partly or entirely chlorine-containing resin or resin mixture with metal, and heating the combination in an inactive atmosphere, in an electric furnace, to a predetermined temperature to carbonize the mixture.

In the process of the present invention, Cr or Fe-Cr alloy in the form of a powder, branch, rod or yarn is directly contacted with the chlorine-containing resin mixture. Thus, various shapes can be easily coated with metal.

Suitable chlorine-containing resins include polyvinyl chloride (PVC), polyvinylidene chloride and rubber chloride.

Suitable metals used in the process of the present invention include preferably Cr or Cr-Fe alloy in the shape of a plate, rod, yarn or powder.

The mixture is produced by mixing the chlorine-containing resin and an organic polymer, or its initial condensate, to produce a mixture containing at least 20 wt. % of the chlorine-containing resin. Alternatively, the mixture may be produced by mixing the chlorine-containing resin with an inorganic filler (such as graphite ceramic) to produce a mixture containing at least 20 wt. % of the chlorine-containing resin.

The resin in contact with the metal is calcined at 1100° C. in an inert gas atmosphere in an electric furnace. The calcining temperature, calcining speed and calcining time depend on the components of the mixture.

According to the process for coating carbonized material with metal of the present invention, a carbon product of arbitrary shape can be coated with metal so long as the carbon product selected can be contacted with the metal. In this case, the metal may be repeatedly used until the metal itself is consumed by exposing new metal surfaces to a file or the like. Thus, the process of the present invention does not require complex operations or complex steps or the use of expensive apparatus. Carbon products of various sizes or shapes can be coated with metal in the electric furnace, and the metal can be repeatedly used until it is consumed. This advantageously reduces the cost of coating carbonized material.

BRIEF DESCRIPTION OF THE DRAWINGS

The above and other related objects and features of the invention will become apparent from the following description of the disclosure and the accompanying drawings, wherein.

DESCRIPTION OF PREFERRED EMBODIMENTS

Preferred embodiments of the process for coating a carbonized material with metal according to the present invention will now be described.

EXAMPLE 1

Figure 1:
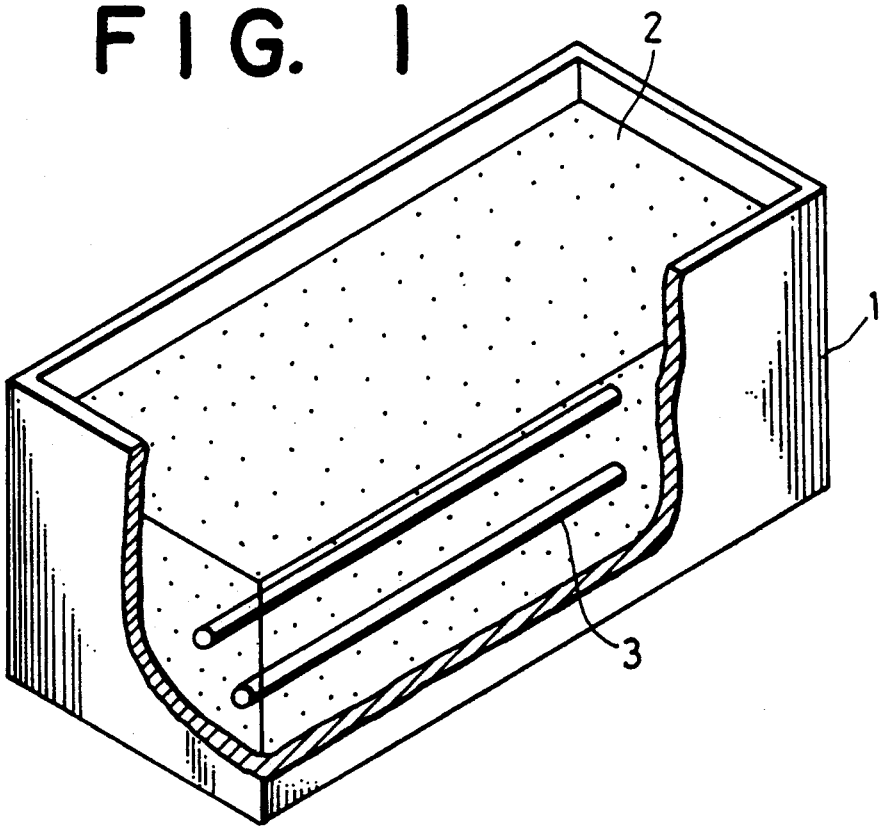
FIG. 1 is a perspective fragmentary view showing a round-rod-like molding coated with stainless steel powder and set in a stainless steel box.
Figure 3:
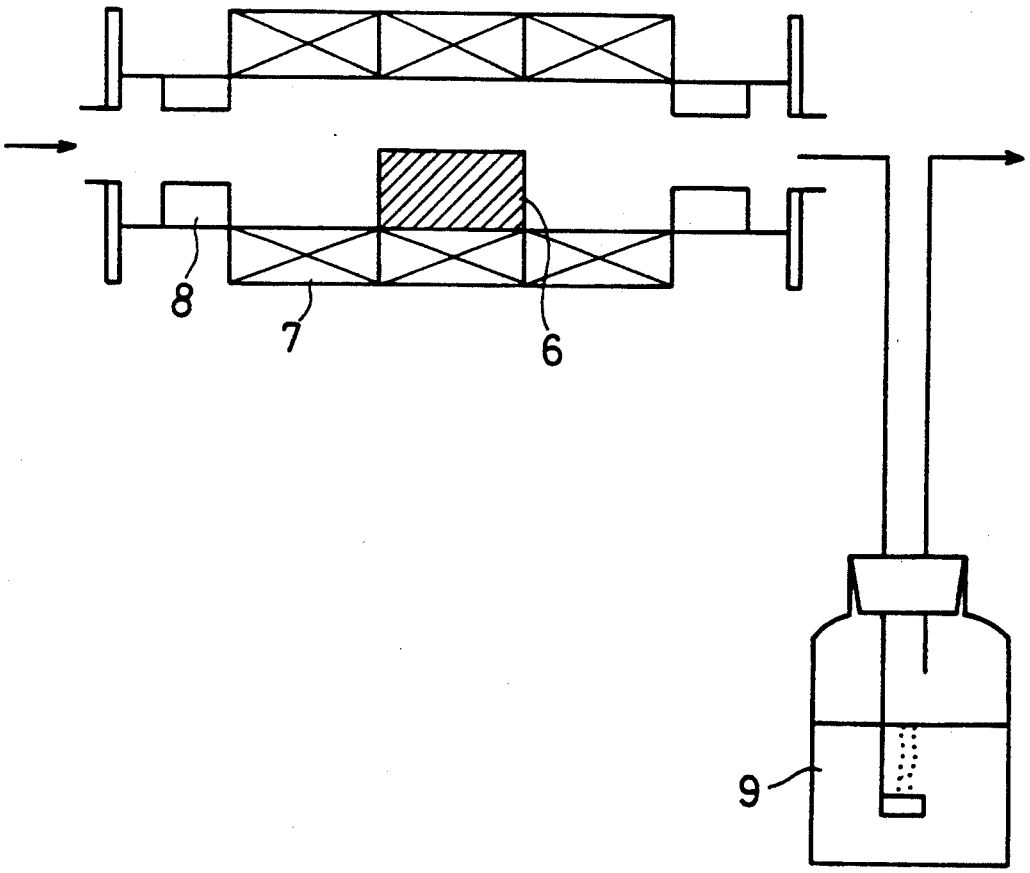
FIG. 3 is a schematic view of an apparatus for coating metal and carbonizing the coated material as well as part of the metal of the invention.

600 g of chlorinated vinyl chloride, 400 g of graphite powder having a grain size of about 10 microns and 300 g of diarylphthalate monomer were mixed in a Henschel mixer for 10 min. The resulting mixture was kneaded by two rollers and then molded into a film. The film was then extruded by a plunger into a round rod having a 2 mm diameter; thereafter the rod was cut to a length of 100 mm to produce a molding 3. The round-rod-like molding 3 was set into molding box 1, as shown in FIG. 1, to be covered with stainless steel powder (SUS-302) 2 having a particle size of up to 100 microns. The molding box 1 was heated in an inactive atmosphere at a temperature which increased by 5° C./hr up to 300° C. in a lateral electric furnace as shown in FIG. 3 wherein 6 is the molding box 1 of FIG. 1, 7 is a heating element, 8 is a spacer and 9 is a filter element. The molding box 1 was then heated again at a temperature which increased by 20° C./hr up to 1100° C. The molding box 1 was allowed to stand at 1100° C. for 3 hours, and then naturally cooled. The metal which contacts the carbide surface of molding 3 was silver grey in color and was uniformly coated on the carbon material surface.

The content of the silver grey material was confirmed with an X-ray microanalyzer to slightly contain Fe in Cr.

EXAMPLE 2

400 g of chlorinated vinyl chloride, 200 g of furan resin, 400 g of graphite powder of up to about 10 micron grain size and 200 g of diarylphthalate monomer were charged into a stainless steel vessel, and then mixed. The resulting mixture was kneaded by two rolls and then rolled flat into a film of 50 mm×50 mm square shape 5 of FIG. 2. The obtained film 5 had a thickness of about 500 microns.

Figure 2:
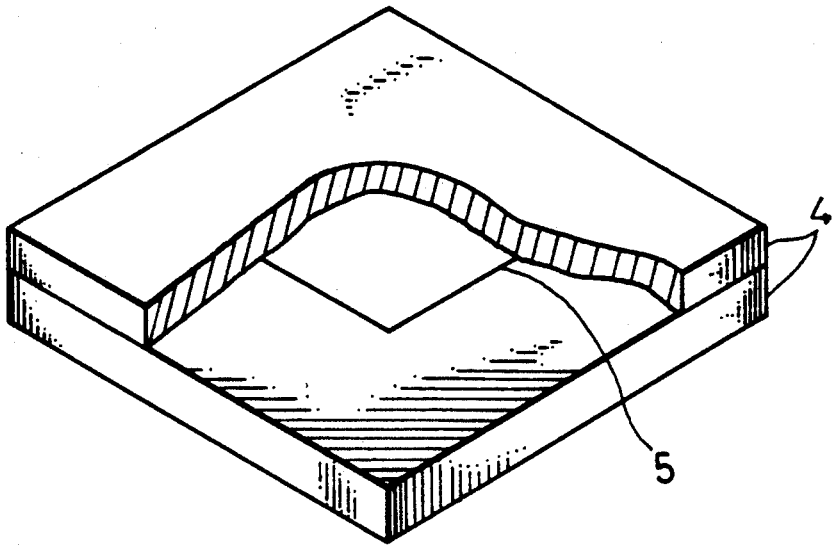
FIG. 2 is a perspective fragmentary view showing a film-like molding set on a stainless steel plate.

This film 5 was set between plate-like SUS-302 stainless steel sheets 4 of 100 mm×100 mm×2 mm as shown in FIG. 2. The assembly was then heated at a temperature which increased by 5° C./hr up to 300° C. in a nitrogen gas atmosphere in the lateral electric furnace shown in FIG. 3. The assembly was thereafter heated at a temperature which increased by 20° C./hr up to 1100° C., allowed to stand for 3 hours at 1100° C., and then naturally cooled. The metal surface of the resultant carbide product exhibited a silver grey color. The silver grey material was confirmed to contain Cr and Fe by the X-ray microanalyzer.

The present invention is not limited to the above preferred embodiments. Various other changes and modifications may be made within the spirit and scope of the present invention.

What is claimed is:

1. A method of making a carbonized molding, comprising:

mixing chlorinated vinyl chloride, graphite powder, and diarylphthalate monomer together to form a mixture;

shaping said mixture into a molding having a desired shape;

contacting said molding with stainless steel powder having a maximum particle size of 100 microns to coat the stainless steel powder on said molding to form a coated molding; and carbonizing the coated molding and forming a carbide layer on the carbonized coated molding by:

heating said coated molding in an inert atmosphere at a rate of 5° C./hr up to 300° C., thereafter heating said coated molding in an inert atmosphere at a rate of 20° C./hr up to a temperature of at least 1100° C.;

holding said coated molding at a temperature of at least 1100° C. for at least three hours; and cooling said coated molding.

* * * * *